US007802561B2

(12) United States Patent
Beilharz et al.

(10) Patent No.: US 7,802,561 B2
(45) Date of Patent: Sep. 28, 2010

(54) METHOD FOR CONTROLLING A VALVE AND METHOD FOR CONTROLLING A PUMP/NOZZLE DEVICE WITH A VALVE

(75) Inventors: Jörg Beilharz, Berlin (DE); Maximillian Kronberger, Regensburg (DE); Richard Pirkl, Regensburg (DE); Sven Rebeschieβ, Kleinmachnow (DE); Harald Schmidt, Vienna (AT); Hans-Jörg Wiehoff, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 34 days.

(21) Appl. No.: 10/596,480

(22) PCT Filed: Dec. 15, 2004

(86) PCT No.: PCT/EP2004/014270

§ 371 (c)(1),
(2), (4) Date: Feb. 27, 2007

(87) PCT Pub. No.: WO2005/061876

PCT Pub. Date: Jul. 7, 2005

(65) Prior Publication Data

US 2007/0240685 A1 Oct. 18, 2007

(30) Foreign Application Priority Data

Dec. 19, 2003 (DE) ..... 103 60 019

(51) Int. Cl.
*F02M 47/02* (2006.01)
*F02M 37/04* (2006.01)

(52) U.S. Cl. ..... 123/498; 239/88; 239/533.2

(58) Field of Classification Search ..... 239/88, 239/533.2, 102.2; 123/490, 496; 310/316.01; 701/104; *F02M 47/02, 37/04*

See application file for complete search history.

(56) References Cited

U.S. PATENT DOCUMENTS 4,784,102 A 11/1988 Igashira et al. ..... 123/447

(Continued)

FOREIGN PATENT DOCUMENTS

CN 1349590 A 5/2002

(Continued)

OTHER PUBLICATIONS

International Search Report for Application No. PCT/EP2004/014270, 3 pages, Dec. 4, 2005.

(Continued)

*Primary Examiner*—Stephen K Cronin
*Assistant Examiner*—Keith Coleman
(74) *Attorney, Agent, or Firm*—King & Spalding L.L.P.

(57) ABSTRACT

A valve has a piezo actuator, a valve element, a valve body and a valve seat. At a predeterminable point in time, the valve element is controlled by a discharging process of the piezo actuator from a position in which it rests against the valve seat to a predetermined position located at a distance from the valve seat. The discharging process is divided into a first discharging period during which a predetermined first amount of electrical energy is discharged from the piezo actuator, a subsequent holding time period during which the piezo actuator is not controlled, and a subsequent second discharging period during which a predetermined second amount of electrical energy is discharged. The holding time duration and/or the first discharging period are/is adapted according to the course of a value that is not characteristic of the oscillation behavior of the piezo actuator during the holding time period.

20 Claims, 4 Drawing Sheets

U.S. PATENT DOCUMENTS

| | | | | |
|---|---|---|---|---|
| 5,057,734 | A * | 10/1991 | Tsuzuki et al. | 310/317 |
| 6,147,433 | A | 11/2000 | Reineke et al. | 310/316.03 |
| 6,240,905 | B1 | 6/2001 | Boecking et al. | 123/498 |
| 6,766,791 | B2 * | 7/2004 | Bock et al. | 123/498 |
| 2002/0113139 | A1 * | 8/2002 | Rodriguez-Amaya et al. | 239/88 |

FOREIGN PATENT DOCUMENTS

| | | | |
|---|---|---|---|
| DE | 197 33 560 | A1 | 8/1997 |
| DE | 198 35 494 | A1 | 8/1998 |
| EP | 1 179 129 | B1 | 4/2000 |
| EP | 1 179 129 | A | 12/2005 |
| WO | WO0068558 | A1 | 11/2000 |

OTHER PUBLICATIONS

International Search Report, PCT/EP2004/014270, 13 pages, Mar. 23, 2006.

German Office Action, German application No. 10330019.1-12. 2 pages, Sep. 21, 2004.

* cited by examiner

METHOD FOR CONTROLLING A VALVE AND METHOD FOR CONTROLLING A PUMP/NOZZLE DEVICE WITH A VALVE

CROSS-REFERENCE TO RELATED APPLICATIONS

This application is a U.S. national stage application of International Application No. PCT/EP2004/014270 filed Dec. 15, 2004, which designates the United States of America, and claims priority to German application number DE 103 60 019.1 filed Dec. 19, 2003, the contents of which are hereby incorporated by reference in their entirety.

TECHNICAL FIELD

The invention relates to a method for controlling a valve. It also relates to a method for controlling a pump/nozzle device with a valve. The valve has a valve actuating device, which is provided in the form of a piezo actuator, a valve element, a valve body and a valve seat. A pump/nozzle device is used in particular in order to feed fuel into a combustion chamber of a cylinder of an internal combustion engine, in particular a diesel internal combustion engine. In the case of a pump/nozzle device a pump, a control unit with the valve and a nozzle unit together comprise a constructional unit. The drive for a piston in the pump is preferably implemented by way of a camshaft of an internal combustion engine by means of a rocker arm.

BACKGROUND

The pump can be connected hydraulically by way of the valve to a low-pressure fuel feed unit. This is connected hydraulically on the output side to the nozzle unit. The start of injection and injection quantity are determined by the valve and its valve actuating device. The compact construction of the pump/nozzle device results in a very small high-pressure volume and a great hydraulic rigidity. Extremely high injection pressures of approximately 2000 bar are thus made possible. This high injection pressure in conjunction with good controllability of the start of injection and the injection quantity make possible a significant reduction in emissions whilst simultaneously keeping fuel consumption low when using the internal combustion engine.

A pump/nozzle device is known from DE 198 35 494 C2 having a pump and a valve with a valve element which controls the hydraulic connection of an auxiliary control chamber with an outflow duct. The outflow duct is connected hydraulically to the pump and to a nozzle unit. An inflow duct is provided which is connected hydraulically to the auxiliary control chamber. A piezoelectric valve actuating device, which allows the valve element to be adjusted between two end positions, is associated with the valve element. In a first end position of the valve element the outflow duct is connected hydraulically to an auxiliary control chamber and the latter in turn to the inflow duct. In a second end position of the valve element the outflow duct is disconnected hydraulically from the auxiliary control chamber and the valve element is in a valve seat of the valve.

In the first end position of the valve element, during a delivery stroke of the pump, fluid is drawn in by the pump from the inflow duct by way of the auxiliary control chamber and the outflow duct. During a working stroke of a pump piston of the pump, in the first end position of the valve element fluid is forced back by the pump by way of the inflow duct and the auxiliary control chamber into the outflow duct.

In the second end position of the valve element, during the delivery stroke of the pump piston no fluid can be forced back on account of the absence of a hydraulic connection between the outflow duct and the auxiliary control chamber and the outflow duct, and the pump piston generates high pressure. When a predetermined pressure threshold is exceeded, a nozzle needle in the nozzle unit opens a nozzle in the nozzle unit and an injection of the fluid takes place. The end of injection is determined by the fact that the valve element is moved into its first end position by means of the actuator, thereby allowing fluid to flow back by way of the outflow duct into the auxiliary control chamber and the inflow duct, as a result of which the pressure in the pump and thus also in the nozzle unit decreases, which in turn leads to closure of the nozzle unit.

Precise metering of fuel through the pump/nozzle device presupposes a capability to control the valve in an extremely precise manner.

A method for controlling an injection valve with a piezoelectric actuator is known from EP 1179129 B1, in which during opening and closing of the valve the piezoelectric actuator is initially recharged with a first boosting charge with a maximum gradient and thus executes a partial stroke. After a recharging interval of a predetermined time period, the piezoelectric actuator is then charged in the same direction with a second partial charge on the final stroke, whereby the gradient for the second partial charge is less than the maximum gradient of the first partial stroke.

SUMMARY

The object of the invention is to set down a method for controlling a valve or a pump/nozzle device with the valve, which guarantees precise control of the valve.

The invention is characterized by a method for controlling a valve with a valve actuating device, which is provided in the form of a piezo actuator, with a valve element, a valve body and a valve seat. At a predetermined point in time the valve element is moved from a position in contact with the valve seat into a predetermined position away from the valve seat by a discharging process of the piezo actuator. The discharging process is divided into a first discharging duration, during which a predetermined first amount of electrical energy is discharged from the piezo actuator, a subsequent holding time duration, during which the piezo actuator is not controlled, and a subsequent second discharging duration, during which a predetermined second amount of electrical energy is discharged from the piezo actuator. The holding time duration and/or the first discharging duration is/are adapted according to the waveform of a variable which is characteristic of the oscillation behavior of the piezo actuator during the holding time duration. By this means, pressure oscillations which occur as a result of the release of the valve seat in a fluid that is flowing through the valve can also easily be greatly dampened under different types of operating conditions of the valve. In addition, noise emissions can thus also be simply reduced.

The variable is preferably the amount of energy which is discharged from or fed to the piezo actuator, or the voltage which drops at the piezo actuator, or the current which flows through the piezo actuator, or the charge stored in it.

The invention is further characterized by a method for controlling the valve, in which at a predetermined point in time the valve element is moved from a predetermined position away from the valve seat into the valve seat by a charging process of the piezo actuator. The charging process is divided into a first charging duration, during which a predetermined first amount of electrical energy is fed to the piezo actuator, a subsequent holding time duration, during which the piezo actuator is not controlled, and a subsequent second charging duration, during which a predetermined second amount of electrical energy is fed to the piezo actuator. The holding time duration and/or the first charging duration is/are adapted according to the waveform of a variable which is characteristic of the oscillation behavior of the piezo actuator during the holding time duration. By this means, bouncing on impact can also be easily reduced under different types of operating conditions of the valve.

The methods are preferably also used for controlling a pump/nozzle device.

In an advantageous embodiment of the invention, the holding time duration and/or the first discharging duration or the first charging duration is/are adapted dependent on an amplitude and/or the period of the waveform of the variable which is characteristic of the oscillation behavior of the piezo actuator during the holding time duration. This is particularly simple.

In a further advantageous embodiment of the invention, the holding time duration is adapted dependent on the period of the waveform of the variable which is characteristic of the oscillation behavior of the piezo actuator during the holding time duration. The holding time duration can thus be set to a particular section of one or more oscillations of the value which is characteristic of the oscillation behavior of the piezo actuator during the holding time duration, thus for example to a half-wave of the variable.

It is furthermore advantageous if the first discharging duration or the first charging duration is adapted dependent on the amplitude of the waveform of the variable which is characteristic of the oscillation behavior of the piezo actuator during the holding time duration. This has the advantage that the amplitude of the waveform of the variable is especially characteristic of a possible occurrence of bouncing or of pressure oscillations in the fluid. As a result of adapting the first discharging duration or the first charging duration, the proportion of the first amount of energy is shifted by the sum of the first and second amounts of energy and the amplitude is thus very effectively changed. Altogether, it is thus possible to more effectively avoid bouncing or to dampen pressure oscillations.

In a further advantageous embodiment of the invention, with regard to the charging process the sum of the first charging duration and the holding time duration is limited to a maximum value, which ensures that the valve element is still in contact with the valve seat. This has the advantage that it is easy to guarantee reliable seating of the valve element in the valve seat after termination of the charging process.

The method can be used particularly advantageously for controlling a pump/nozzle device when the first discharging duration is limited to a minimum value, which ensures that a nozzle needle of the nozzle unit of the pump/nozzle device closes a nozzle through which the fuel is being metered. Since the nozzle needle for the pump/nozzle device is connected hydraulically by way of an outflow duct to the valve, this therefore ensures that an end to fuel delivery is not affected.

BRIEF DESCRIPTION OF THE DRAWINGS

Exemplary embodiments of the invention will be described in the following with reference to the schematic drawings, in which.

DETAILED DESCRIPTION

Figure 1:
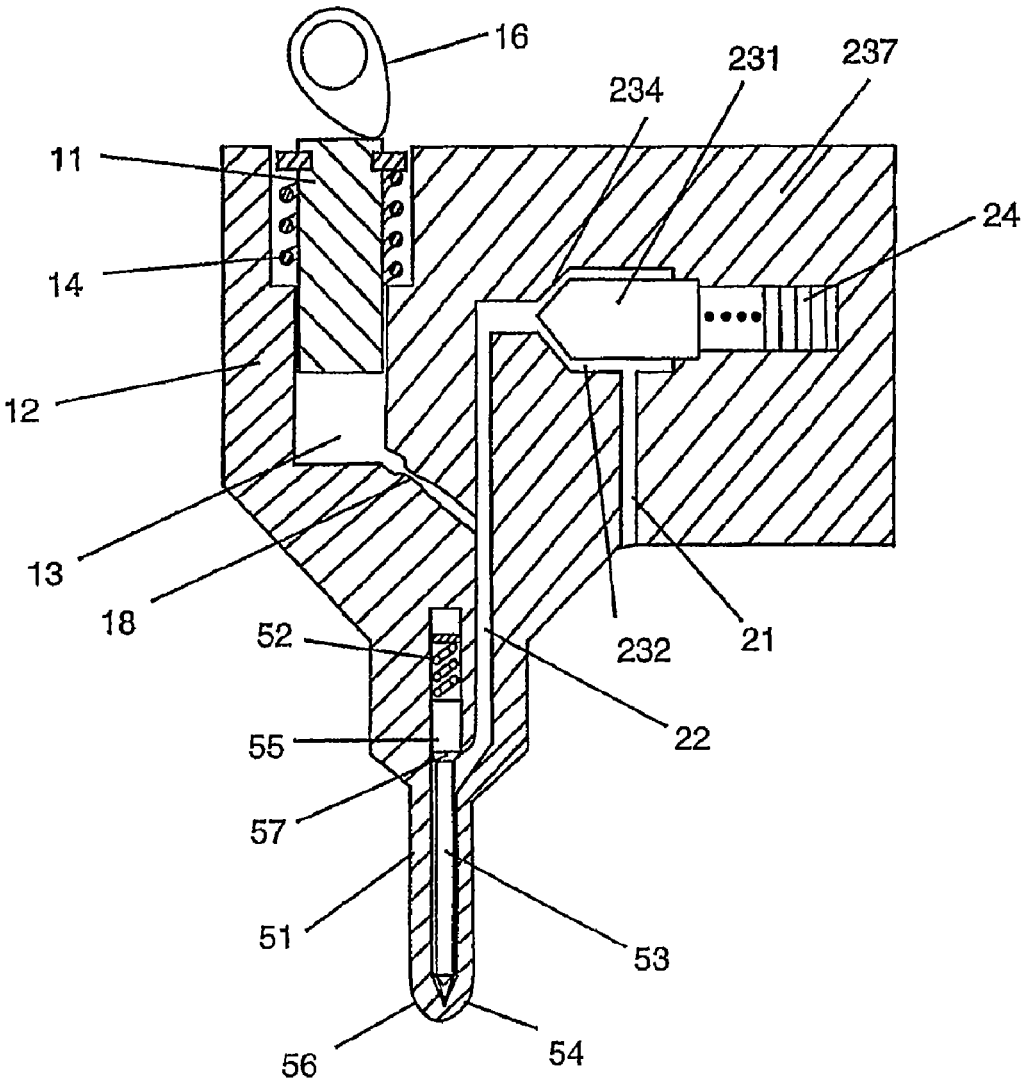
FIG. 1 shows a pump/nozzle device with a valve and a device for controlling the valve, in which the method for controlling the valve is processed.

Elements having the same construction and function are identified by the same reference characters in all the figures.

The pump/nozzle device (FIG. 1) comprises a pump unit, a control unit and a nozzle unit. The pump/nozzle device is preferably used for delivering fuel into the combustion chamber of a cylinder of an internal combustion engine. The internal combustion engine preferably takes the form of a diesel internal combustion engine. The internal combustion engine has an induction tract for the intake of air, which can be connected to cylinders by means of gas inflow valves. The internal combustion engine also has an exhaust gas tract which, under control of the outflow valve, carries away the gases to be expelled from the cylinders. The cylinders each have a piston assigned to them, which pistons are each connected by way of a connecting rod to a crankshaft. The crankshaft is connected to a camshaft.

The pump unit comprises a piston 11, a pump body 12, a working space 13 and a pump return facility 14 which preferably takes the form of a spring. When incorporated in an internal combustion engine the piston 11 is connected to a camshaft 16, preferably by means of a rocker arm, and is driven by the latter. The piston 11 is guided in a recess in the pump body 12 and, depending on its position, determines the volume of the working space 13. The pump return facility 14 takes a form and is arranged such that the volume of the working space 13 delimited by the piston 11 exhibits a maximum value when no external forces are acting on the piston 11, in other words forces which are transmitted through the coupling with the camshaft 16.

The nozzle unit comprises a nozzle body 51, in which are arranged a nozzle return facility 52, which takes the form of a spring and where applicable also of a damping unit, and a nozzle needle 53. The nozzle needle 53 is arranged in a recess in the nozzle body and is guided in the area of a needle guide 55.

In a first state, the nozzle needle 53 is in contact with a needle seat 54 and thus closes a nozzle 56 which is provided for delivering the fuel into the combustion chamber of the cylinder of the internal combustion engine. The nozzle unit, as illustrated, preferably takes the form of an inward opening nozzle unit.

In a second state, the nozzle needle 53 is slightly distanced from the needle seat 54 and is actually located in the direction of the nozzle return facility 52 and thus opens the nozzle 56. In this second state, fuel is metered into the combustion chamber of the cylinder of the internal combustion engine. The first or second state is adopted depending on a balance of forces between the force which acts through the nozzle return facility 52 on the nozzle needle 53 and the force acting in opposition to this which is caused by the hydraulic pressure in the area of the needle shoulder 57.

The control unit comprises an inflow duct 21 and an outflow duct 22. The inflow duct 21 and the outflow duct 22 can be connected hydraulically by means of a valve. The inflow duct 21 is routed from a low-pressure side connection on the pump/nozzle device to the valve. The outflow duct 22 is connected hydraulically to the working space 13 and is routed to the needle shoulder 57 and can be connected hydraulically to the nozzle 56 according to the state that is adopted by the nozzle needle 53.

The valve comprises a valve element 231 which preferably takes the form of a so-called A-valve, in other words it opens outwards against the direction of flow of the fluid. The valve also comprises an auxiliary control chamber 232 which is connected hydraulically to the inflow duct 21 and can be connected hydraulically to a high-pressure space by means of the valve element 231. The high-pressure space is connected hydraulically to the outflow duct 22.

When the valve element 231 is in the closed position, the valve element 231 is in contact with a valve seat 234 of a valve body 237. Furthermore, a valve return facility is provided which is arranged and implemented such that it pushes the valve element 231 into an open position, in other words distanced from the valve seat 234, when the forces acting on the valve element through an actuator 24 are smaller than the forces acting on the valve element 231 through the valve return facility. The valve return facility is preferably a spring. The actuator 24 takes the form of a piezo actuator with a piezo stack.

The actuator 24 is preferably connected by means of a transmitter, which preferably amplifies the stroke of the actuator 24, to the valve element 231. Preferably also provided on the actuator 24 is a connector for accommodating electrical contacts for controlling the actuator 24.

A device 60 for controlling the pump/nozzle device is provided which generates appropriate actuating signals for the valve.

When the valve element 231 is in the open position and a movement of the piston 11 occurs in the upward direction, in other words in the direction away from the nozzle 56, fuel is drawn into the working space 13 through the inflow duct 21. As long as the valve element 231 continues to remain in its open position during a subsequent downward movement of the piston 11, in other words in the case of a movement towards the nozzle 56, the fuel situated in the working space 13 and the outflow duct 22 is forced back through the valve again into the auxiliary control chamber 232 and if need be into the inflow duct 21.

If however during the downward movement of the piston 11 the valve element 231 is moved into its closed position, the fuel situated in the working space 13 and thus also the fuel in the outflow duct 22 and the fuel in the high-pressure space 233 is compressed, whereby as the downward movement of the piston 11 increases, the pressure increases in the working space 13, in the high-pressure space 233 and in the outflow duct 22. In accordance with the rising pressure in the outflow duct 22 the force caused by the hydraulic pressure, which acts on the needle shoulder 57 in the direction of an opening movement of the nozzle needle 53 in order to open the nozzle 56, is also increased. If the pressure in the outflow duct 22 exceeds a value at which the force, caused by the hydraulic pressure, acting on the needle shoulder 57 is greater than the counteracting force of the nozzle return facility 52, the nozzle needle 53 moves away from the needle seat 54 and thus opens the nozzle 56 for the delivery of fuel to the cylinder of the internal combustion engine. The nozzle needle 53 then moves back again into the needle seat 54 and thereby closes the nozzle 56 when the hydraulic pressure in the outflow duct 22 lies below the value at which the force caused by the hydraulic pressure at the needle shoulder 57 is less than the force caused by the nozzle return facility 52. The point in time at which this value is not reached and at which the fuel metering is thus terminated can be influenced by driving the valve element 231 from its closed position into an open position.

The hydraulic connection between the high-pressure space and the auxiliary control chamber 232 and the inflow duct 21 is established by moving the valve element from its closed position into its open position. As a result of the great pressure difference prevailing on opening between the fluid in the high-pressure space and the outflow duct 22 and the fluid in the auxiliary control chamber 232 and the inflow duct 21, the fuel then flows from the high-pressure space at very high speed, normally at the speed of sound, into the auxiliary control chamber 232 and onward into the inflow duct 21. As a result, the pressure in the high-pressure space and the outflow duct 22 is then quickly reduced to such a significant extent that the forces exerted by the nozzle return facility 52 and acting on the nozzle needle 53 lead to the nozzle needle 53 moving into the needle seat 54 and thus then closing the nozzle 56.

Figures 2A, 2B, 2C:
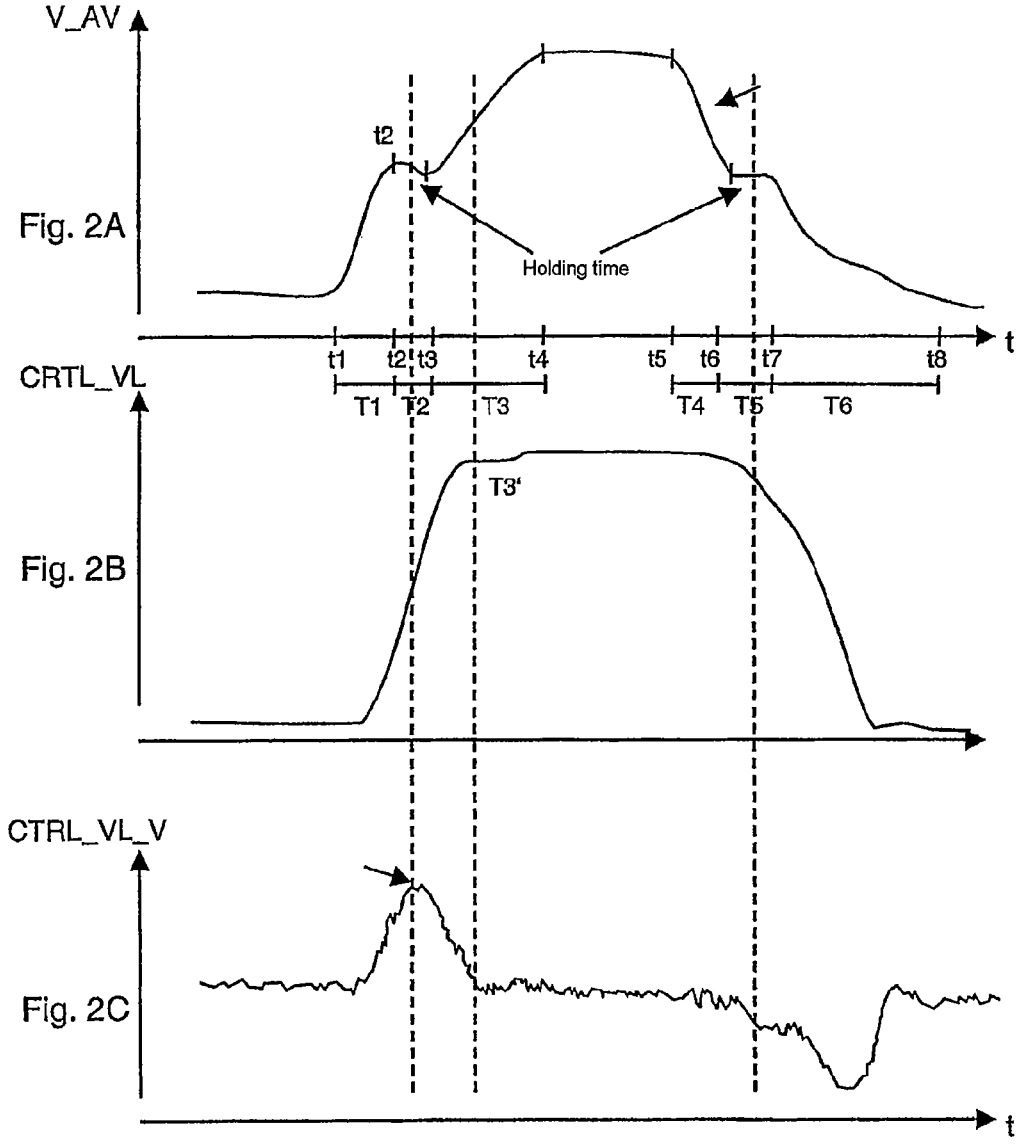
FIGS. 2*a*, 2*b*, 2*c* show timing waveforms for the piezo voltage V_INJ, the stroke CTRL_VL of the valve element 231 and the speed CTRL_VL_V of the stroke CTRL_VL of the valve element 231.

FIG. 2*a* shows the waveform of the actual values V_AV for the voltage drop at the piezo actuator entered over the time t. FIG. 2*b* shows the stroke CTRL_VL of the valve element 231 entered over the time t and FIG. 2*c* shows the waveform of the speed CTRL_VL_V of the stroke of the valve element 231. A charging process of the piezo actuator is started at a point in time t1. The precise control of the charging process is described below with reference to FIG. 3. A first amount of electrical energy is fed to the piezo actuator during a first charging duration T1, which is completed at a point in time t2. Subsequent to the point in time t2 no electrical energy is fed to the piezo actuator for a holding time duration T2, which is terminated at a point in time t3. Subsequent to this, a second predetermined amount of electrical energy is fed to the piezo actuator for a second charging duration T3, and this is actually distributed over the second charging duration T3, which is terminated at a point in time t4. From a point in time t3' the valve element 231 is in contact with the valve seat 234.

From a point in time t5 a discharging process of the piezo actuator is controlled which is likewise described in more detail further below. Firstly, the piezo actuator is discharged with a predetermined first amount of energy for a first discharging duration T4, and this actually takes place up to a point in time t6. Subsequent to this, the piezo actuator is not further discharged for a predetermined holding time duration T5, and this is actually up to a point in time t7. Subsequent to this, the piezo actuator is further discharged for a second discharging duration T6, during which a predetermined second amount of electrical energy is dissipated. The discharging process is then completed at a point in time t8. The valve element 231 is then again located in its predetermined position distanced from the valve seat 234.

Figure 3:
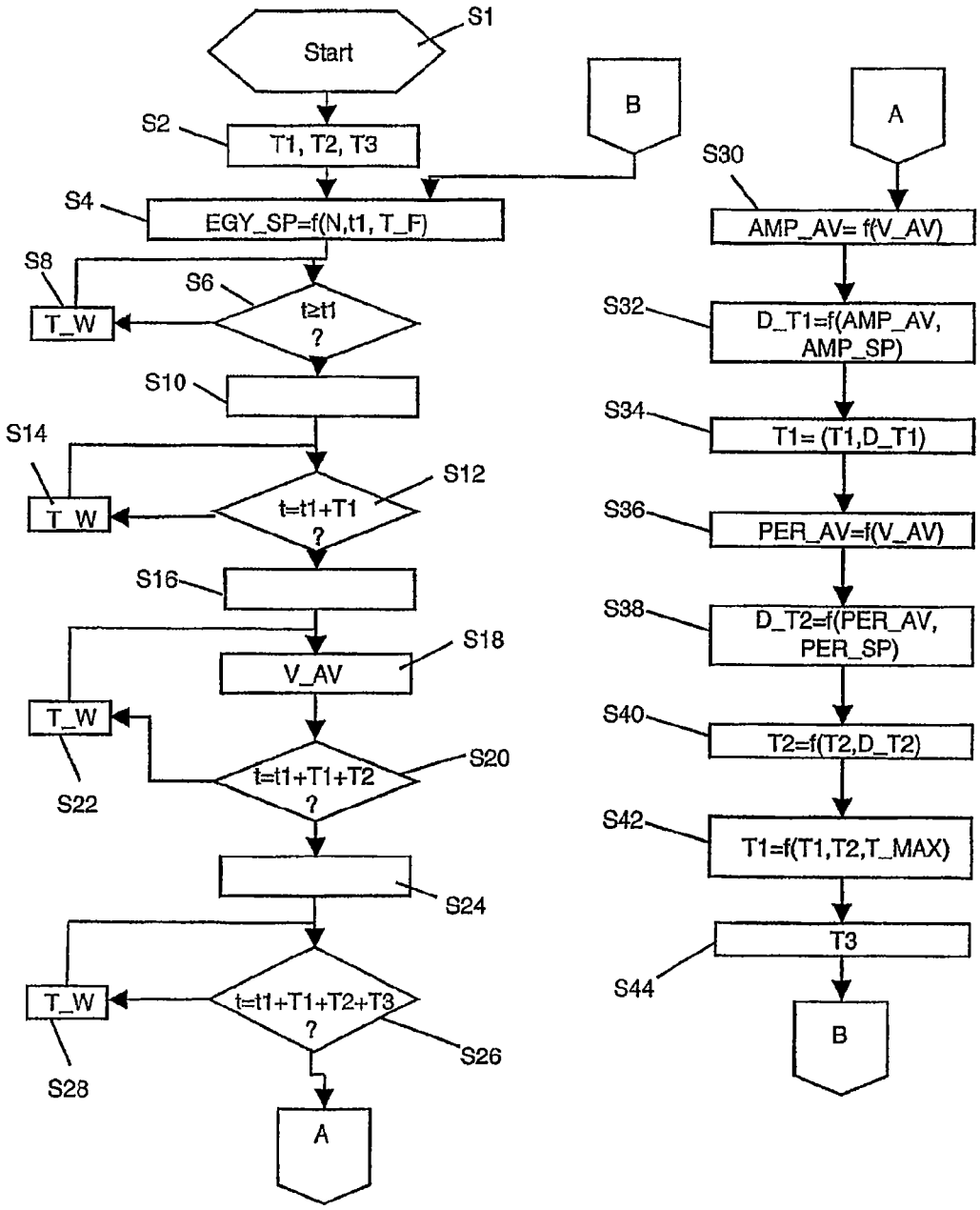
FIG. 3 shows a flowchart of a program for controlling the pump/nozzle device.

The control of the charging process is described in the following with reference to the flowchart shown in FIG. 3, which is stored in the form of a program in the device for controlling the pump/nozzle device, and is loaded and executed during operation. The program is started in a step S1 in which variables are initialized if need be.

In a step S2, the first charging duration T1, the second charging duration T3 and the holding time duration T2 are read in. In this situation, the values for the first and second charging durations T1, T3 and the holding time duration T2 can be permanently predetermined in the step S2 or can have been saved at the end of a preceding pass of the program or can be ascertained in another way.

In a step S4, a setpoint value EGY_SP is then ascertained for an amount of energy to be fed to the piezo actuator during the charging process, depending on a rotational speed N of the crankshaft of an internal combustion engine, the point in time t1, and a fuel temperature T_F.

In a step S6, a check is made as to whether the current time t is the same as the point in time t1. If this is not the case, then the program pauses for a predetermined waiting duration T_W in a step S8. The predetermined waiting duration T_W is chosen to be sufficiently short as to ensure during a subsequent renewed check on the condition for step S6 that the current time t is at most equal to or only insignificantly greater than the point in time t1.

If the condition associated with step S6 is satisfied, then the feed of a first amount of electrical energy to the piezo actuator is started in a step S10. During the course of steps S10 and subsequent steps S12 and S14 a first amount of energy is fed to the piezo actuator and this is actually done in accordance with the setpoint value EGY_SP for the amount of energy to be fed proportionately in accordance with the ratio of the first charging duration T1 to the sum of the first charging duration T1 and the second charging duration T3. The feed of the electrical energy takes place by appropriately applying current to the piezo actuator. In the step S12, a check is then made as to whether the current time t is the same as or greater than the sum of the point in time t1 and the first charging duration T1. If this is not the case, then the program pauses in a step S16 for the predetermined waiting duration T_W before the condition associated with step S12 is checked again. If however the condition associated with step S12 is satisfied, then in a step S16 a pause is forced in the charging process and this is done for the holding time duration T2. During this holding time duration T2 the voltage which drops across the piezo actuator and which is captured in a subsequent step S18 as actual values V_AV for the voltage drop at the piezo actuator exhibits a characteristic oscillation waveform which is caused by the excitation of a spring mass oscillator which comprises the piezo actuator, the valve element 231 and the return facility, whereby the excitation is brought about by the charging process during the first charging duration T1.

In a step S20, a check is then made as to whether the current time t is greater than or equal to the point in time t1 and the sum of the first charging duration T1 and the holding time duration T2. If the condition associated with step S20 is not satisfied, then the program pauses for the predetermined waiting duration T_W in the step S22 before a further actual value V_AV for the voltage drop across the piezo actuator in the step S18 is captured. The actual values V_AV for the voltage drop across the piezo actuator captured in step S18 are buffered for the subsequent processing.

If the condition associated with step S20 is satisfied however, then the charging process is continued in a step S24 and during the following processing in steps S26 to S28 the piezo actuator is fed with a predetermined second amount of electrical energy, which corresponds to the fraction of the first setpoint value EGY_SP of the electrical energy to be fed, which corresponds to the proportion of the second charging duration T3 in the sum of the first and second charging durations T1, T3.

Following on from step S24 a check is made in a step S26 as to whether the current time t is greater than or equal to the point in time t1 and the sum of the first and second charging durations T1, T3 and the holding time duration T2. If the condition associated with step S26 is not satisfied, then the program pauses for the predetermined waiting duration T_W in step S28 before the condition associated with step S26 is checked again.

If the condition associated with step S26 is satisfied however, then in a step S30 an actual value AMP_AV is ascertained for the amplitude of the waveform of the actual values V_AV for the voltage drop at the piezo actuator, which have been ascertained during the holding time duration T2.

In a step S32, a correction value D T1 is subsequently ascertained dependent on the actual value AMP_AV and a setpoint value AMP_SP for the amplitude. The setpoint value AMP_SP for the amplitude is preferably a permanently predefined value or a value which is ascertained in preliminary form preferably by way of trial dependent on operating parameters for the valve or the pump/nozzle device and this is done in such a manner that in the event of the slightest deviation of the actual value AMP_AV for the amplitude from the setpoint value AMP_SP for the amplitude any bouncing of the valve element 231 when it encounters the valve seat 234 is reduced in the desired manner. By preference, the correction value D_T1 for the first charging duration T1 is ascertained by means of a regulator which preferably exhibits P or PI behavior.

In a step S34, a corrected first charging duration T1 is then ascertained dependent on the charging duration T1 and the correction value D_T1 for the first charging duration.

In a step S36, an actual value PER_AV is then ascertained for the period of the oscillation of the waveform of the actual values V_AV for the voltage drop at the piezo actuator during the holding time duration T2.

In a step S38, a correction value D_T2 is then ascertained for the holding time duration dependent on the actual value PER_AV for the period and on a setpoint value PER_SP for the period. The setpoint value PER_SP for the period is chosen in the same way as the setpoint value AMP_SP for the amplitude such that if the actual value PER_AV approaches the setpoint value PER_SP for the period the bouncing of the valve element is reduced in the desired manner.

In a step S40, a corrected holding time duration T2 is then ascertained dependent on the holding time duration T2 and the correction value D_T2 for the holding time duration.

In a step S42, a check is then made as to whether the first charging duration T1 in total with the holding time duration T2 is greater than a maximum value T_MAX, whereby the corrected time periods T1 and T2 are relevant in each case during processing of step S42. If this is the case, then in step S42 the first charging duration T1 is limited in a manner such that the sum of the first charging duration T1 and the holding time duration T2 is not greater than the maximum value T_MAX.

In a step S44, the second charging duration T3 is changed in the opposite way to the first charging duration T1 such that the sum of the first and second charging durations T1,T3 remains unchanged.

Processing of the program is then subsequently continued again in step S4 if a renewed charging process is to be controlled.

In a simpler embodiment of the program, it also is possible to adapt only the first charging duration T1 or the holding time duration T2. Furthermore, in the step S18 it is also possible to capture a variable other than that for the voltage drop at the piezo actuator, which is characteristic of the oscillation behavior of the piezo actuator during the holding time duration T2. This is for example the electrical energy stored in the piezo actuator, the current flow through the piezo actuator or the electrical charge in the piezo actuator.

Furthermore, in a simpler embodiment of the program, in the step S30 it is possible to ascertain only the maximum and minimum values of the actual values V_AV captured in the step S18 and then in an appropriately adapted step S32 to ascertain the correction value D_T1 for the first charging duration T1, dependent on the maximum and minimum values and corresponding reference values.

Figure 4:
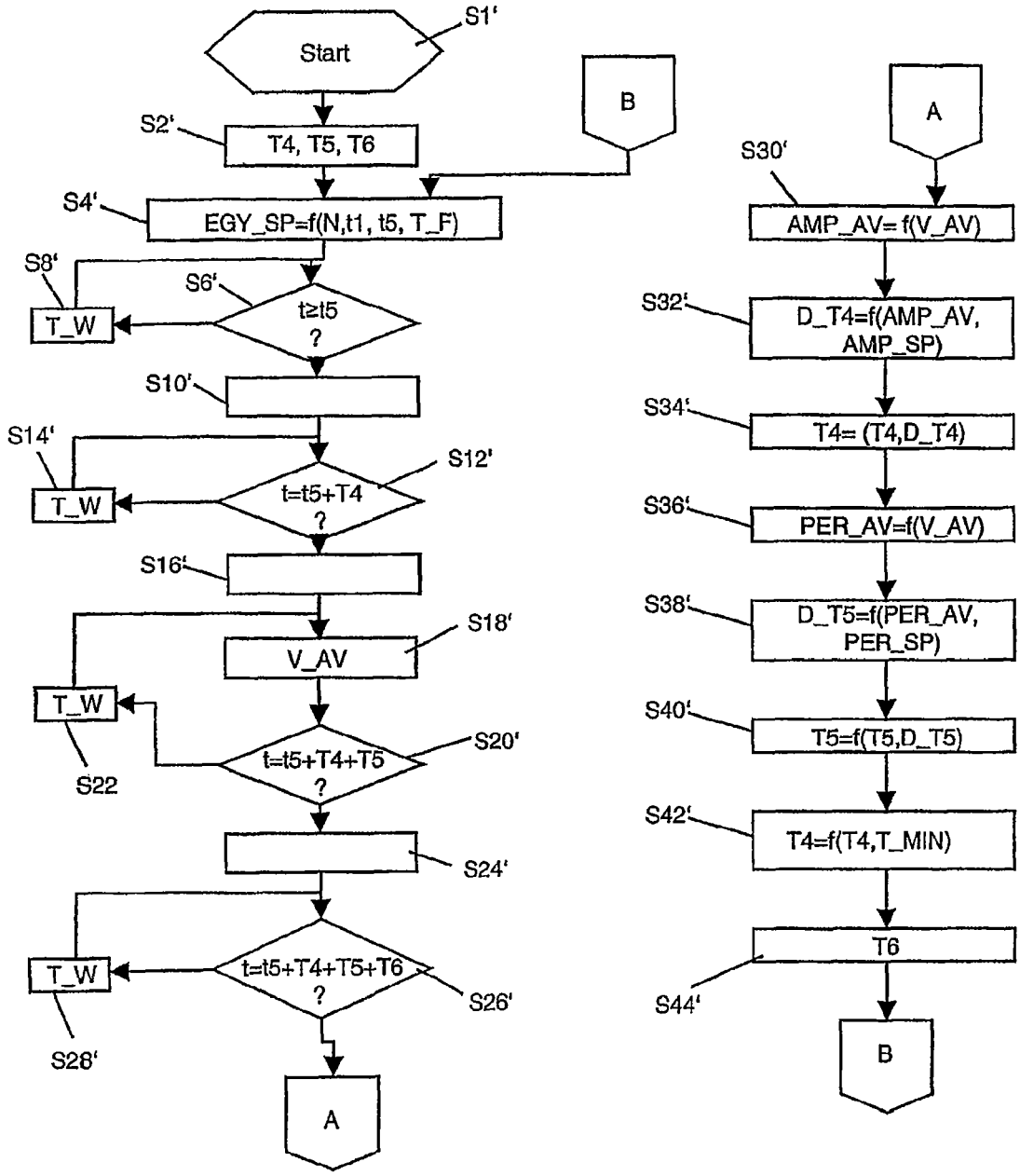
FIG. 4 shows a further flowchart of a program for controlling the pump/nozzle device.

A program for controlling a discharging process of the piezo actuator is described in the following with reference to the flowchart shown in FIG. 4. The steps of the program according to FIG. 4 are essentially analogous to the steps of the program shown in FIG. 3 and just the differences are described in the following. The program is started in a step S1'. In a step S2', values for the first discharging duration T4, the holding time duration T5 and the second discharging duration T6 are read in, values which for simplicity are permanently predetermined or can be predetermined dependent on operating variables for the valve or else have been saved during a preceding pass of the program.

In a step S4', a setpoint value EGY_SP is ascertained for the electrical energy which is to be removed from the piezo actuator during the discharging process. This is done dependent on the rotational speed N, the point in time t1, the point in time t5 and preferably dependent on the fuel temperature T_F.

In a step S6' a check is made as to whether the current time t is greater than the time t5, and if this is the case then the discharging process is started in a step S10' and a first amount of electrical energy is removed from the piezo actuator, corresponding to the fraction of the setpoint value EGY_SP for the electrical energy which is to be removed from the piezo actuator in accordance with the ratio of the first discharging duration T4 and the sum of the first discharging duration T4 and the second discharging duration T6. The piezo actuator is subsequently discharged appropriately during the further processing of the steps S12' and S16' until a pause in the discharging process occurs in the step S16', and this is done for the predetermined holding time duration T5. In a step S18', actual values V_AV for the voltage drop at the piezo actuator are ascertained, corresponding to the step S18.

In a step S20', a check is made as to whether the current time is greater than or equal to the point in time t5 and the sum of the first discharging duration T4 and the holding time duration T5. If the condition associated with the step S20' is satisfied, then the discharging process is continued in a step S24', and this is done for the second discharging duration T6, whereby during the subsequent processing of the steps S26' and S28' in total a second predetermined amount of electrical energy is removed from the piezo actuator whose value corresponds to the fraction of the setpoint value EGY_SP for the electrical energy which is to be removed from the piezo actuator corresponding to the proportion of the second discharging duration T6 in the sum of the first and second charging durations T4,T6.

The step S30' corresponds to the step S30. In a step S32', a correction value D_T4 for the first discharging duration T4 is subsequently ascertained dependent on the actual value AMP_AV and a setpoint value AMP_SP for the amplitude of the oscillation of the waveform of the actual values V_AV for the voltage drop at the piezo actuator. This happens by analogy with step S32 and is done in such a manner that pressure oscillations and noise emissions from the pump/nozzle device are greatly dampened in the desired manner.

In a step S34', a corrected first discharging duration T4 is then ascertained dependent on the first discharging duration T4 and the correction value D_T4 for the first discharging duration T4. A step S36' then corresponds to the step S36. In a step S38', a correction value D_T5 for the holding time duration T5 is then ascertained dependent on the actual value PER_AV for the period duration, and the setpoint value PER_SP for the period. The setpoint value PER_SP for the period is predetermined such that the desired damping of pressure oscillations and noise emissions is achieved when the actual value PER_AV approaches the setpoint value PER_SP for the period in the pump/nozzle device.

In a step S40', the holding time duration T5 is then corrected dependent on the holding time duration T5 and the correction D_T5 for the holding time duration.

In a following step S42', a check is then made as to whether the first discharging duration T4 is less than a minimum value T_MIN which is preferably ascertained dependent on the rotational speed N, the point in time t1, the point in time t5 and the fuel temperature T_F. If the first discharging duration T4 is less than the minimum value T_MIN, then the first discharging duration T4 is equated with the minimum value T_MIN. This ensures that during any subsequent processing of the steps S2' to S42' the end of delivery by pump/nozzle device, in other words the closure of the nozzle needle 53, is not influenced by the interruption of the discharging process subsequent to the first discharging duration T4. The step S42' can then be dispensed with if appropriately higher-level control functions of the pump/nozzle device, which ascertain the desired points in time t1 and t5, are appropriately adapted.

In a step S44', the second charging duration T6 is changed in the opposite way to the first charging duration T4 such that the sum of the first and second charging durations T4,T6 remains unchanged.

By controlling the discharging process in accordance with the program shown in FIG. 4 it is possible in a simple and extremely effective manner to reduce troublesome pressure pulses following on from the valve element 231 releasing from the valve seat 234 and thus to effectively reduce noise emissions from the pump/nozzle device.

With regard to the control of the charging process described above with reference to FIG. 3, in step S30 an actual value AMP_AV is ascertained for the amplitude and in step S36 an actual value PER_AV is ascertained for the period of the oscillation of the waveform of the actual values V_AV for the voltage drop at the piezo actuator, which have been ascertained during the holding time duration T2. In the subsequent steps S32 and S38, a correction value D_T1 for the first charging duration T1 or a correction value D_T2 for the holding time duration T2 respectively is ascertained from the actual value AMP_AV or PER_AV respectively and the associated setpoint value AMP_SP or PER_SP respectively.

With regard to the control of the discharging process described above with reference to FIG. 4, corresponding actual values AMP_AV and PER_AV are ascertained in corresponding steps S30' and S36'. In corresponding steps S32' and S38', dependent on the actual values AMP_AV and PER_AV and also the assigned setpoint values AMP_SP and PER_SP, correction values D_T4 for the first discharging duration T4 and D_T5 for the holding time duration T5 during the discharging process are ascertained.

The actual values AMP_AV and PER_AV are preferably ascertained for each charging process and each discharging process. Accordingly, the correction values D_T1, D_T2 are ascertained during each charging process and the correction values D_T4 and D_T5 are ascertained during each discharging process. This corresponds to four independent control loops, in which the actual values AMP_AV and PER_AV for the charging process and for the discharging process are the control variables and the first charging duration T1, the holding time duration T2, the first discharging duration T4 and the holding time duration T5 are the correcting variables.

According to a preferred variant, the correction values D_T1, D_T2, D_T4 and D_T5 are ascertained dependent not only on the most recent actual value AMP_AV or PER_AV but in each case also dependent on a plurality of actual values AMP_AV or PER_AV ascertained during previous charging processes or discharging processes. Each of the four control loops can then exhibit I, PI ID or PID characteristics, for example.

As an alternative to the assignment of correcting variables and control variables described above, other control loops can also be advantageous. Any desired linear or non-linear combinations or functions thereof also come into consideration as control variables in addition to the actual values AMP_AV and PER_AV. Any of these control variables which relates to the charging process can be combined with any correcting variable of the charging process (first charging duration T1, holding time duration T2). Likewise, any of the aforementioned control variables which relates to the discharging process can be combined with any correcting variable of the discharging process (first discharging duration T4, holding time duration T5).

Instead of the actual values AMP_AV and PER_AV for the amplitude and PER_AV for the period, any other values ascertained from the actual values V_AV captured during the holding time duration T2 or T5 can be used as control variables. Examples of such further control variables which characterize the oscillation behavior of the piezo actuator just like AMP_AV and PER_AV are the maximum gradient dV_AV/dt during the holding time duration T2 or T5, the maximum absolute value of the gradient |dV AV/dt| during the holding time duration T2 or T5, the maximum gradient dV_AV/dt or the maximum absolute value |dV_AV/dt| of the gradient between the first two extremes, the voltage difference or the duration between the first two extremes or combinations or functions of these values. In this situation it has proved to be particularly simple and particularly advantageous to use the voltage difference and/or the duration between the first maximum and the first minimum of the voltage drop at the piezo actuator at the beginning of the holding time T2 during the charging process or between the first minimum and the first maximum of the voltage drop at the piezo actuator at the beginning of the holding time duration T5 during the discharging process.

If the present invention is used in a pump-nozzle injection device for an internal combustion engine, depending on the mechanical design of the injection device, a regime can be achieved particularly in the case of raised and high rotational speeds of the internal combustion engine in which the control valve needle no longer quite reaches the valve seat, in other words no longer completely closes because the injection pulses become extremely short. This regime is referred to as a ballistic regime. In addition, the holding time durations T2, T5 can be reduced with increasing rotational speed and can disappear at high rotational speeds. Under these conditions it can be advantageous to effect the described control only at rotational speeds close to the idling speed. At higher rotational speeds the correcting variable is then simply recorded.

Above all (but not only) in the last-mentioned case it is advantageous, departing from the above descriptions, not to use the first charging duration T1, the holding time duration T2, the first discharging duration T4 or the holding time duration T5 as the correcting variable but to use a parameter (an offset, for example) which is included in the calculation of the correcting variable, whereby in addition further operating parameters such as the actual rotational speed, the fuel temperature etc. are included in the calculation.

In a simpler embodiment of the program according to FIG. 4, it is also not possible to adapt either the first discharging duration T4 or the holding time duration T5.

What is claimed is:

1. A method for controlling a valve with a valve actuating device, which is provided in the form of a piezo actuator, with a valve element, a valve body and a valve seat, the method comprising the steps of:

opening the valve by moving the valve element at a predeterminable point in time from a position in contact with the valve seat into a predetermined position away from the valve seat by a discharging process of the piezo actuator, dividing the discharging process into a first discharging duration, during which a predetermined first amount of electrical energy is discharged from the piezo actuator, a subsequent holding time duration, during which the piezo actuator is not controlled, and a subsequent second discharging duration, during which a predetermined second amount of electrical energy is discharged from the piezo actuator, and dependent on the waveform of a voltage at the piezo actuator or a current through the piezo actuator which is characteristic of the oscillation behavior of the piezo actuator during the holding time duration, adapting the holding time duration and/or the first discharging duration in order to ensure precise control of the valve.

2. A method for controlling a valve with a valve actuating device, which is provided in the form of a piezo actuator, with a valve element, a valve body and a valve seat, the method comprising the steps of:

closing the valve by moving the valve element at a predeterminable point in time from a predetermined position away from the valve seat into the valve seat by a charging process of the piezo actuator, dividing the charging process into a first charging duration, during which a predetermined first amount of electrical energy is fed to the piezo actuator, a subsequent holding time duration, during which the piezo actuator is not controlled, and a subsequent second charging duration, during which a predetermined second amount of electrical energy is fed to the piezo actuator, and dependent on the waveform of a voltage at the piezo actuator or a current through the piezo actuator which is characteristic of the oscillation behavior of the piezo actuator during the holding time duration, adapting the holding time duration and/or the first charging duration in order to ensure precise control of the valve.

3. A method according to claim 1, wherein the holding time duration and/or the first discharging duration or the first charging duration is/are adapted dependent on the amplitude and/or the period of the waveform of the variable which is characteristic of the oscillation behavior of the piezo actuator during the holding time duration.

4. A method according to claim 3, wherein the holding time duration is adapted dependent on the period of the waveform of the variable which is characteristic of the oscillation behavior of the piezo actuator during the holding time duration.

5. A method according to claim 3, wherein the first discharging duration or the first charging duration is adapted dependent on the amplitude of the waveform of the variable which is characteristic of the oscillation behavior of the piezo actuator during the holding time duration.

6. A method according to claim 2, wherein the sum of the first charging duration and the holding time duration is limited to a maximum value, which ensures that the valve element is still in contact with the valve seat.

7. A method according to claim 1, wherein the valve is part of a pump/nozzle device with a pump, which has a piston and a working space, and a control unit, which comprises an outlet duct that is connected hydraulically to the working space, the piezo actuator that forms a valve actuating device, and the valve, whereby, the valve comprises a valve element, a valve body, a valve seat and an auxiliary control chamber which is disconnected hydraulically from the outlet duct when the valve element is in contact with the valve seat and which otherwise is connected hydraulically to the outlet duct.

8. A method according to claim 7, wherein the first discharging duration is limited to a minimum value, which ensures that the nozzle needle closes the nozzle.

9. Method according to claim 2, wherein the holding time duration and/or the first discharging duration or the first charging duration is/are adapted dependent on the amplitude and/or the period of the waveform of the variable which is characteristic of the oscillation behavior of the piezo actuator during the holding time duration.

10. A method according to claim 9, wherein the holding time duration is adapted dependent on the period of the waveform of the variable which is characteristic of the oscillation behavior of the piezo actuator during the holding time duration.

11. A method according to claim 9, wherein the first discharging duration or the first charging duration is adapted dependent on the amplitude of the waveform of the variable which is characteristic of the oscillation behavior of the piezo actuator during the holding time duration.

12. A method according to claim 2, wherein the valve is part of a pump/nozzle device with a pump, which has a piston and a working space, and a control unit, which comprises an outlet duct that is connected hydraulically to the working space, the piezo actuator that forms a valve actuating device, and the valve, whereby the valve comprises a valve element, a valve body, a valve seat and an auxiliary control chamber which is disconnected hydraulically from the outlet duct when the valve element is in contact with the valve seat and which otherwise is connected hydraulically to the outlet duct.

13. A method according to claim 12, wherein the first discharging duration is limited to a minimum value, which ensures that the nozzle needle closes the nozzle.

14. An arrangement for controlling a valve with a valve actuating device, which is provided in the form of a piezo actuator, with a valve element, a valve body and a valve seat, comprising:

means for closing the valve by moving the valve element at a predeterminable point in time from a predetermined position away from the valve seat into the valve seat by a charging process of the piezo actuator, means for dividing the charging process into a first charging duration, during which a predetermined first amount of electrical energy is fed to the piezo actuator, a subsequent holding time duration, during which the piezo actuator is not controlled, and a subsequent second charging duration, during which a predetermined second amount of electrical energy is fed to the piezo actuator, and dependent on the waveform of a voltage at the piezo actuator or a current through the piezo actuator which is characteristic of the oscillation behavior of the piezo actuator during the holding time duration, means for adapting the holding time duration and/or the first charging duration in order to ensure precise control of the valve.

15. An arrangement according to claim 14, wherein the holding time duration and/or the first discharging duration or the first charging duration is/are adapted dependent on the amplitude and/or the period of the waveform of the variable which is characteristic of the oscillation behavior of the piezo actuator during the holding time duration.

16. An arrangement according to claim 15, wherein the holding time duration is adapted dependent on the period of the waveform of the variable which is characteristic of the oscillation behavior of the piezo actuator during the holding time duration.

17. An arrangement according to claim 15, wherein the first discharging duration or the first charging duration is adapted dependent on the amplitude of the waveform of the variable which is characteristic of the oscillation behavior of the piezo actuator during the holding time duration.

18. An arrangement according to claim 14, wherein the sum of the first charging duration and the holding time duration is limited to a maximum value, which ensures that the valve element is still in contact with the valve seat.

19. An arrangement according to claim 14, wherein the valve is part of a pump/nozzle device comprising a pump, which has a piston and a working space, and a control unit, which comprises an outlet duct that is connected hydraulically to the working space, the piezo actuator that forms a valve actuating device, and the valve, whereby the valve comprises a valve element, a valve body, a valve seat and an auxiliary control chamber which is disconnected hydraulically from the outlet duct when the valve element is in contact with the valve seat and which otherwise is connected hydraulically to the outlet duct.

20. An arrangement according to claim 19, wherein the first discharging duration is limited to a minimum value, which ensures that the nozzle needle closes the nozzle.

* * * * *